US005934294A

United States Patent [19]

Chiang

[11] Patent Number: 5,934,294

[45] Date of Patent: Aug. 10, 1999

[54] STRUCTURE OF A HAIR ORNAMENT

[76] Inventor: Chiu-Jung Chiang, No. 149-2, Iu Shan, Iu Shan Tsun, Nan Hua Shiang, Tainan Shien, Taiwan

[21] Appl. No.: 09/181,552

[22] Filed: Oct. 29, 1998

[51] Int. Cl.[6] ..... A45D 8/00

[52] U.S. Cl. ..... 132/275; 63/15; 63/31

[58] Field of Search ..... 132/275; 63/15, 63/29.1, 29.2, 30, 3.1

[56] References Cited

U.S. PATENT DOCUMENTS

| | | | |
|---|---|---|---|
| 327,101 | 9/1885 | Palmer | 63/29.1 |
| 1,052,141 | 2/1913 | Gaschke | 63/29.1 |
| 1,060,631 | 5/1913 | Rich et al. | 63/15 |
| 2,316,225 | 4/1943 | De Le Hottman et al. | 63/15 |
| 2,354,513 | 7/1944 | Fitzer | 63/15 |
| 3,533,247 | 10/1970 | Douglas | 63/29.1 |
| 3,805,549 | 4/1974 | Nielsen | 63/29.1 |
| 3,835,664 | 9/1974 | Nesbit | 63/29.2 |
| 4,052,864 | 10/1977 | Hofsaess | 63/29.2 |
| 5,048,311 | 9/1991 | Mastrobuono | 63/29.1 |
| 5,427,123 | 6/1995 | Odenthal | 132/275 |
| 5,573,018 | 11/1996 | Johnson | 132/275 |
| 5,829,457 | 11/1998 | Huang | 132/275 |

*Primary Examiner*—Paul J. Hirsch
*Attorney, Agent, or Firm*—Rosenberg, Klein & Bilker

[57] ABSTRACT

A structure of a hair ornanent includes a main body of the hair ornament, an elastic wire and an ornamental block. One end of the elastic wire is provided in a proper position of the main body, and the other end of the elastic wire is connected with the ornamental block. While the main body being worn on the hair of a user, the ornamental block will swing accordingly by the elasticity of the elastic wire through the move of the user's body and head or the influence of external forces so as to make the hair ornament look vivid and interesting. This invention is also provided with easily assembled and disassembled skills so that it is convenient for a user to replace another ornamental block.

5 Claims, 5 Drawing Sheets

STRUCTURE OF A HAIR ORNAMENT

BACKGROUND OF THE INVENTION

1. Field of the Invention

This invention relates to a structure of a hair ornament which looks vivid, interesting and is easily assembled and disassembled so that it is convenient for a user to replace another ornamental block.

2. Description of the Related Art

Referring to FIG. 1, a conventional main body of a hair ornament, such as a hair clasp (A) or a hair clip (B) etc., is integrately manufactured, and then an ornamental block is attached firmly to the main body by glue so that the ornamental block can not be detached from the main body. Therefore, a user must buy a plurality of hair ornaments with different ornamental blocks for uses in different occasions. They not only cost much but also occupy restoring space. Besides, a conventional hair ornament is stiff, plane and dull because the ornamental block is glued on the main body.

SUMMARY OF THE INVENTION

In view of the drawbacks of the prior art mentioned above, an objective of the present invention is to provide a structure of a hair ornament which looks vivid and interesting.

Another objective of the present invention is to provide a structure of a hair ornament which is easily assembled and disassembled so that it is convenient for a user to replace another favorite ornamental block.

Accordingly, a structure of a hair ornament includes a main body of the hair ornament, an elastic wire and an ornamental block. One end of the elastic wire is provided in a proper position of the main body, and the other end of the elastic wire is connected with the ornamental block. While the main body being worn on the hair of a user, the ornamental block will swing accordingly by the elasticity of the elastic wire through the move of the user's body and head or the influence of external forces so as to make the hair ornament look vivid and interesting.

The structure of a hair ornament in the present invention may be assembled in fixed ways: it may be integrately manufactured; two ends of the elastic wire can be respectively fixedly connected with the main body and the ornamental block by coherence, magnetic attachment or welding according to different materials.

A separable assembling skill provided in the present invention is to insert one end of the elastic wire in a hole provided in a proper position of the main body. Adjacent to the hole is provided with an inserting opening for the hook portion of the elastic wire to be inserted into. On the bottom of the ornamental block is provided with a protruding portion with an inserting opening for the other hook portion of the elastic wire to be inserted into, and an external end is left outside the inserting opening. When the outer end being compressed, the other hook portion of the elastic wire can be pulled out of the inserting opening so as to make the ornamental block be separated from the elastic wire. Thus, it is convenient for a user to replace another favorite ornamental block.

Another separable assembling skill is to provide with a screw hole in a proper position of the main body for one end of the elastic wire to be placed in and then fixed by a screw. In the bottom of the ornamental block is also provided with a screw hole for the other end of the elastic wire to be placed in and then fixed by a screw. Thus, it is convenient for a user to replace another favorite ornamental block.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 2:
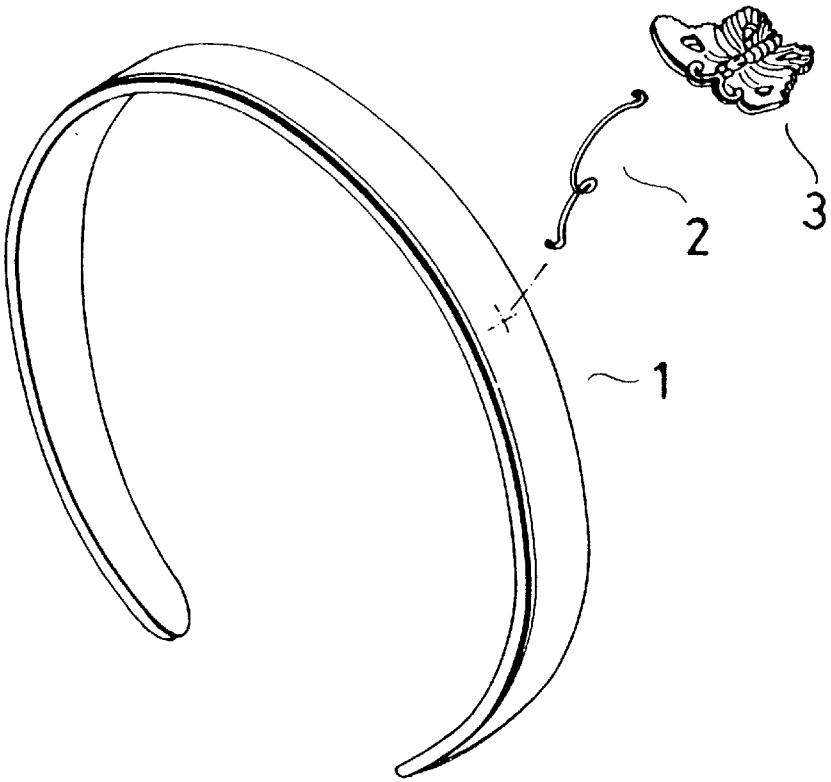
FIG. 2 is a disassembled perspective view of a structure of a hair ornament in the present invention.

First, referring to FIG. 2, a structure of a hair ornament in the present invention includes a main body 1, an elastic wire 2 and an ornamental block 3. The main body 1 is a conventional hair ornament, such as a hair clasp or a hair clip, and is provided for a user to wear on the head. A proper surface position of the main body 1 is provided for one end of the elastic wire 2 to be planted in and fixed. The elastic wire 2 has a proper length, is made of hard and elastic material such as steel so as to be adjusted and transformed to be straight, wavy or spiral. One end of the elastic wire 2 is provided in one proper surface position of the main body 1, and the other end is connected with the ornamental block 3. The ornamental block 3 may be any kind of configuration such as an animal, a plant, a cartoon character, etc. The bottom of the ornamental block 3 is connected with the other end of the elastic wire 2.

Figure 1B:
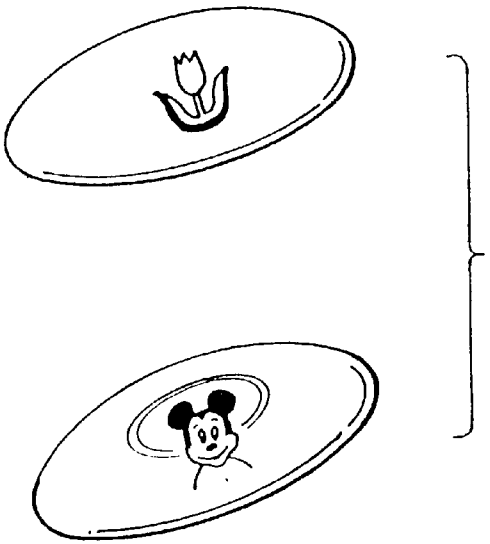
FIG. 1B (PRIOR ART)
FIG. 1 is a perspective view of conventional hair ornaments.
Figure 1A:
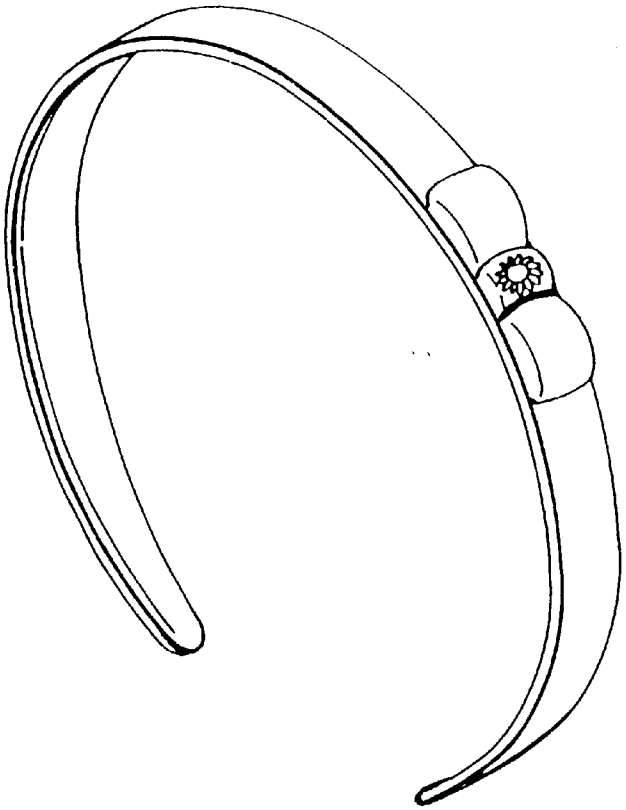
FIG. 1A (PRIOR ART)
Figure 3:
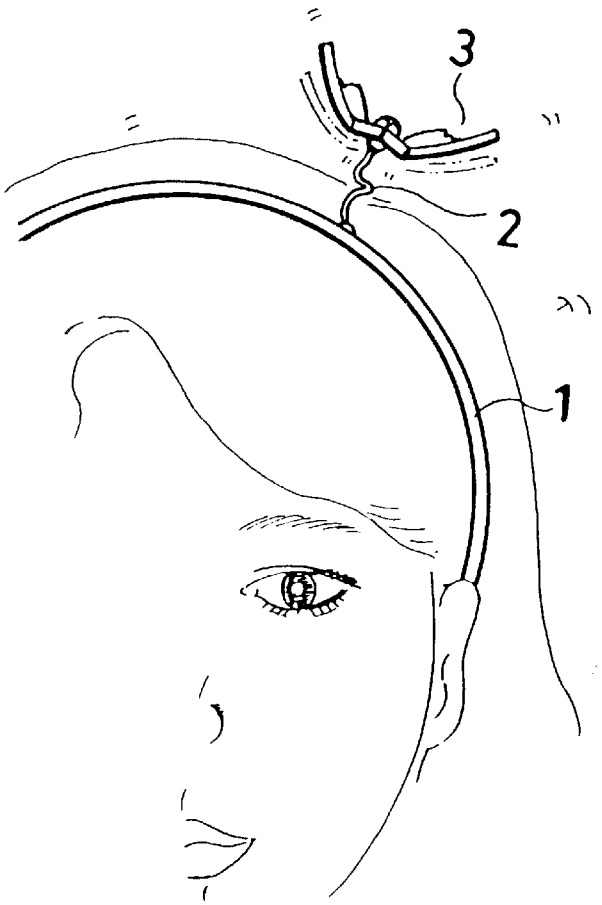
FIG. 3 is an assembled front elevation view of a structure of a hair ornament in the present invention.
Figure 7:
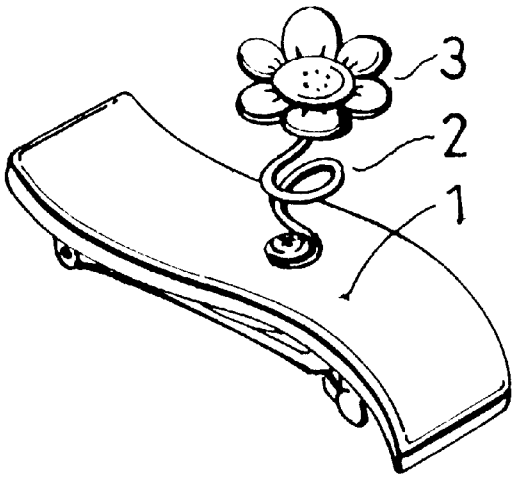
FIG. 7 is an assembled perspective view of another preferred embodiment of a structure of a hair ornament in the present invention; and, FIG. 8 is an assembled sectional view of another preferred embodiment of a structure of a hair ornament in the present invention.

Referring to FIG. 3 or FIG. 7, while the hair ornament with the above-mentioned structure in the present invention being worn on a user's head, the ornamental block 3 will swing accordingly by the elasticity of the elastic wire 2 through the move of the user's body and head or the influence of external forces. Therefore, the ornamental block 3 with a certain configuration will swing rhythmically and vividly.

Figure 8:
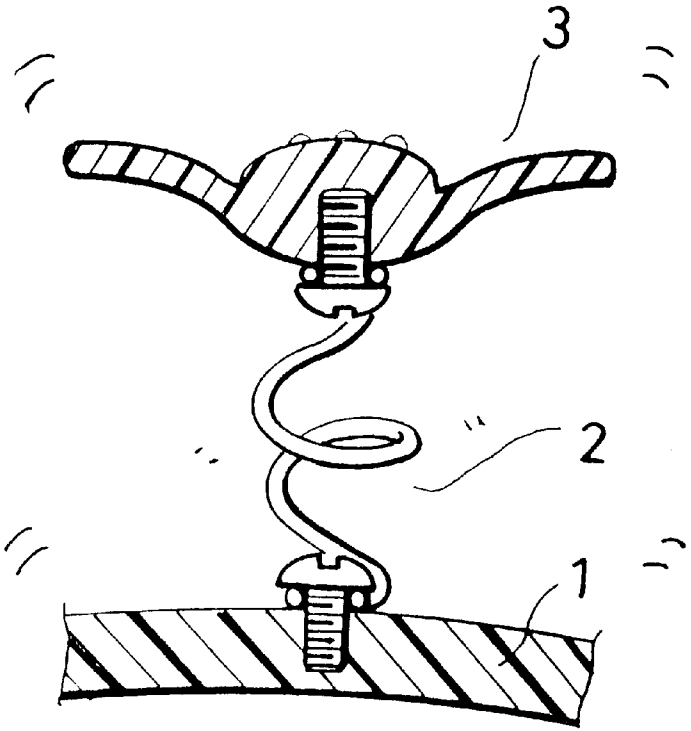

Referring to FIGS. 2, 3, 4 ,5 and 6, the structure of a hair ornament in the present invention may be assembled in fixed ways the main body 1, the elastic wire 2 and the ornamental block 3 may be integrately manufactured; two ends of the elastic wire 2 may be respectively fixedly connected with the main body 1 and the ornamental block 3 by coherence, magnetic attachment or welding, etc., according to different materials; referring to FIGS. 7 and 8, two ends of the elastic wire 2 may be bended and then respectively provided in and fixed in one proper position of the main body 1 and on the bottom of the ornamental block 3 by screws.

Figure 4:
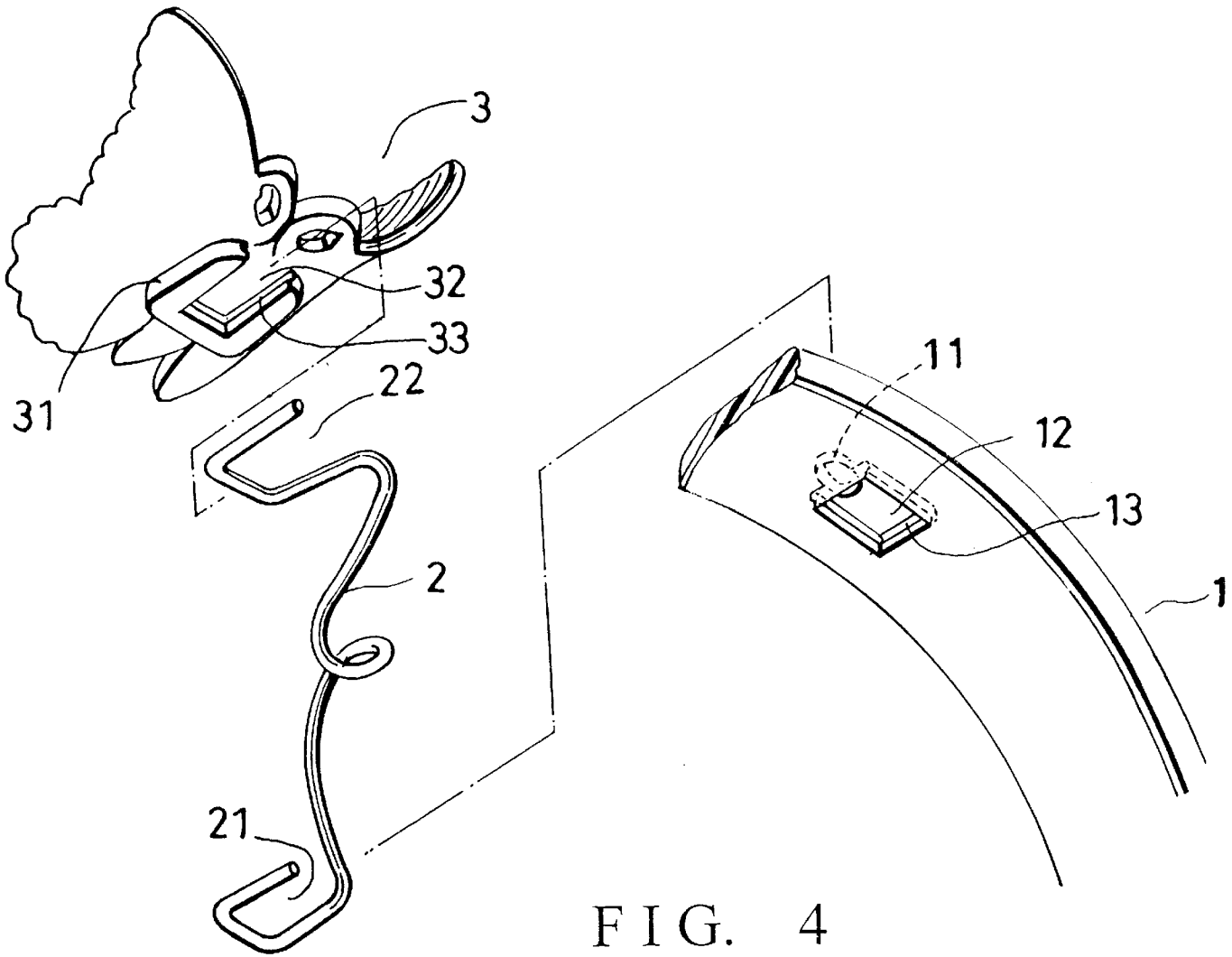
FIG. 4 is a disassembled perspective view of a preferred embodiment of a structure of a hair ornament in the present invention.
Figure 6:
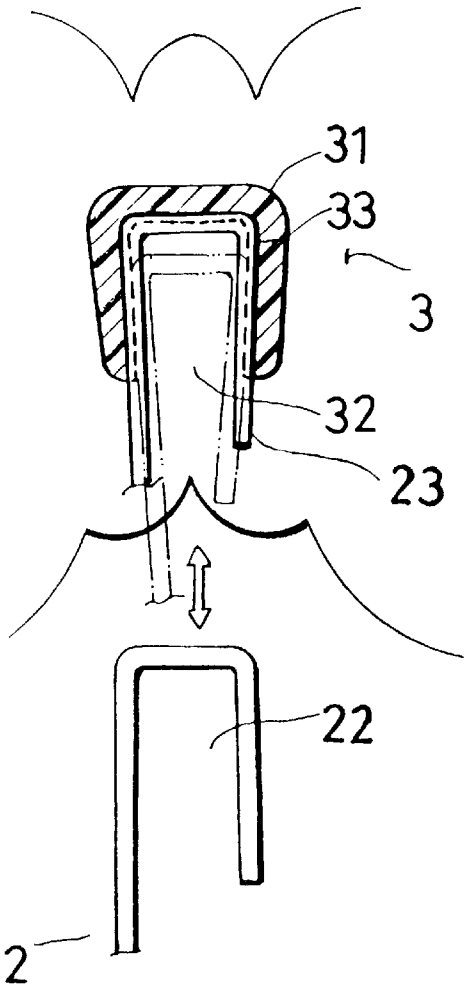
FIG. 6 is a schematic view showing how the hook portion being inserted into and pulled out of the inserting opening of a preferred embodiment of a structure of a hair ornament in the present invention.
Figure 5:
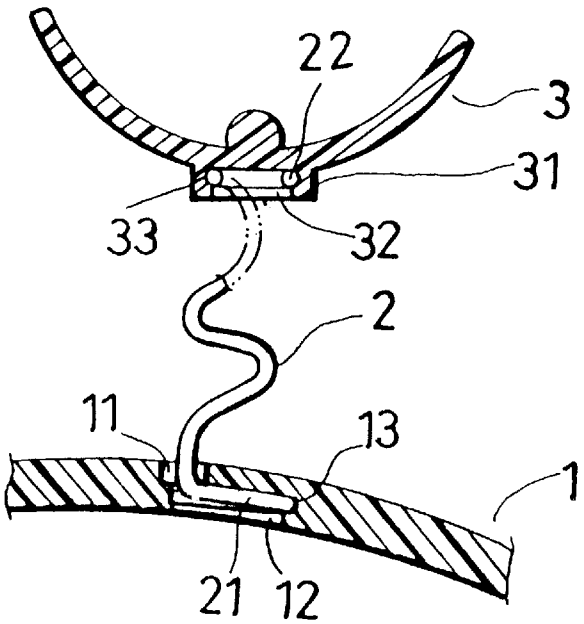
FIG. 5 is an assembled sectional view of a preferred embodiment of a structure of a hair ornament in the present invention.

A preferred embodiment of the present invention is particularly provided with one separable assembling skill. Referring to FIG. 4, in one proper position of the main body 1 is provided with a hole 11, and on the inner surface is provided with an inserting opening 12 adjacent to the hole 11. A sliding groove 13 is provided in the inner side wall of the inserting opening 12. One end of the elastic wire 2 is bended to form a hook portion 21 so as to penetrate through the hole 11 of the main body 1 and insert into the inserting opening 12 and then to be against the sliding groove 13. Because the elastic wire 2 has elasticity itself, the hook portion 21 will elastically open to be firmly against the sliding groove 13. The other end of the elastic wire 2 is also bended to form a hook portion 22.

On the central bottom of the ornamental block 3 is provided with a protruding portion 31, and in one side of the protruding portion 3 1 is provided with an inserting opening 32 with a sliding groove 33 in the inner side wall for the hook portion 22 of the elastic wire 2 to be inserted into the inserting opening 32 and then to be against the sliding groove 33. When the hook portion 22 being provided in the inserting opening 32, an external end 23 is left outside the inserting opening 32. The other end of the elastic wire 2 can be separated from the ornamental block 3 after the external end 23 being compressed to make the hook portion 22 be pulled out of the inserting opening 32.

The structure of a hair ornament assembled by the above-mentioned assembling skill is not only easily assembled but also conveniently disassembled. That is, the external end 23 of the other hook portion 22 of the elastic wire 2 is compressed to make the width of the hook portion 22 be less than that of the inserting opening 32 first, and then the hook portion 22 is pulled out so as to separate itself from the ornamental block 3 and thus for a user to replace another favorite ornamental block 3.

The above-mentioned fixed assembling skill by screwing can also have the function of disassembling. That is, screw holes are respectively provided in proper positions of the main body 1 and the bottom of the ornamental block 3, and screws are provided in two ends of the elastic wire 2. Therefore, the structure of a hair ornament may be easily assembled and disassembled by screwing.

Accordingly, the structure of a hair ornament in the present invention, either by the fixed or by the separable assembling skills, is vivid and interesting and has a unique style; at the same time, it is able to be provided with a structure which is easily assembled and disassembled so as to replace another ornamental block.

While the preferred embodiments of the invention have been described above, it will be recognized and understood that various modifications may be made therein and the appended claims are intended to cover all such modifications which may fall within the spirit and scope of the invention.

What is claimed is:

1. A hair ornament, comprising:

a main body adapted to be worn on a user's head;

an elastic wire having first and second opposing end portions, said first end portion being coupled to said main body; and, an ornamental block disposed in spaced relationship from said main body and having a lower surface coupled to said second end portion of said elastic wire, said elastic wire being sufficiently flexible to provide oscillatory displacement of said ornamental block responsive to movement of the user's head.

2. The hair ornament as recited in claim 1, wherein said main body is formed with a hole, a first insert opening formed in a first inner edge portion of said main body circumscribing said hole, and a first sliding groove formed in a second inner edge portion of said main body circumscribing said hole, said first end of said elastic wire being hook-shaped for insertion into said first insert opening through said hole and capture within said first sliding groove.

3. The hair ornament as recited in claim 2, wherein said ornamental block includes a protruding portion formed on said lower surface thereof, said protruding portion having a second insert opening formed in one side thereof and a second sliding groove formed in a side of said second insert opening, said second end of said elastic wire being hook-shaped for insertion into said second insert opening and capture within said second sliding groove for releasable coupling therebetween.

4. The hair ornament as recited in claim 3, wherein said second end of said elastic wire has an end portion disposed external to said protruding portion for displacement by the user to release said elastic wire from said ornamental block.

5. The hair ornament as recited in claim 1, wherein said ornamental block includes a protruding portion formed on said lower surface thereof, said protruding portion having an insert opening formed in one side thereof and a sliding groove formed in a side of said insert opening, said second end of said elastic wire being hook-shaped for insertion into said insert opening and capture within said sliding groove for releasable coupling therebetween.

* * * * *